United States Patent [19]

Offutt

[11] 4,308,445

[45] Dec. 29, 1981

[54] CONTROLLED MOVABLE SUPPORT FOR MICROWAVE OVEN

[75] Inventor: Carl R. Offutt, Marion, Ohio

[73] Assignee: Whirlpool Corporation, Benton Harbor, Mich.

[21] Appl. No.: 111,656

[22] Filed: Jan. 14, 1980

[51] Int. Cl.[3] ..... H05B 6/78

[52] U.S. Cl. ..... 219/10.55 F; 219/10.55 B; 219/10.55 E

[58] Field of Search ..... 219/10.55 F, 10.55 E, 219/10.55 B, 10.55 R, 10.55 A, 10.55 D

[56] References Cited

U.S. PATENT DOCUMENTS

| | | | |
|---|---|---|---|
| 3,737,608 | 6/1973 | Nagao et al. | 219/10.55 R |
| 4,037,070 | 7/1977 | Kirpichnikov et al. | 219/10.55 A |
| 4,115,678 | 9/1978 | Tachikawa et al. | 219/10.55 B |
| 4,149,056 | 4/1979 | Kaneshiro et al. | 219/10.55 R |
| 4,162,381 | 7/1979 | Buck | 219/10.55 B |
| 4,191,877 | 3/1980 | Tanaka et al. | 219/10.55 B |

FOREIGN PATENT DOCUMENTS

| | | | |
|---|---|---|---|
| 52-16037 | 2/1977 | Japan | 219/10.55 F |
| 52-92454 | 7/1977 | Japan | 219/10.55 E |

*Primary Examiner*—Arthur T. Grimley
*Assistant Examiner*—Philip H. Leung
*Attorney, Agent, or Firm*—Wegner, Stellman, McCord, Wood & Dalton

[57] ABSTRACT

A microwave oven structure wherein a movable food support is selectively positionable in any one of a plurality of preselected different discrete positions. The support may be moved to the different positions during the cooking cycle as by a programmed timer. Alternatively, the support may be moved as a function of a sensed condition of the food being cooked, such as a temperature differential occurring therein. The movement of the support may be limited so as to permit the use of a probe inserted into the food being cooked without damage to the wires connecting the probe to the control of the oven. The support, in the illustrated embodiment, is a turntable which is controlledly rotated less than a full turn in repositioning the food being cooked.

19 Claims, 9 Drawing Figures

FIG. 1
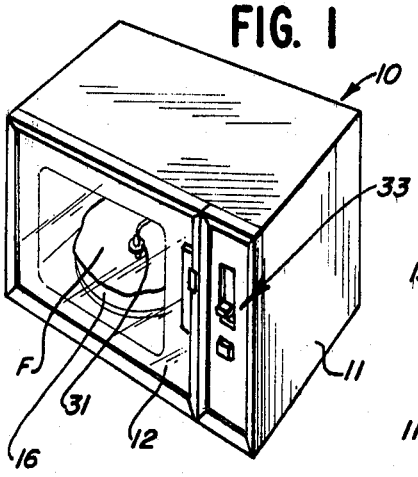
FIG. 2
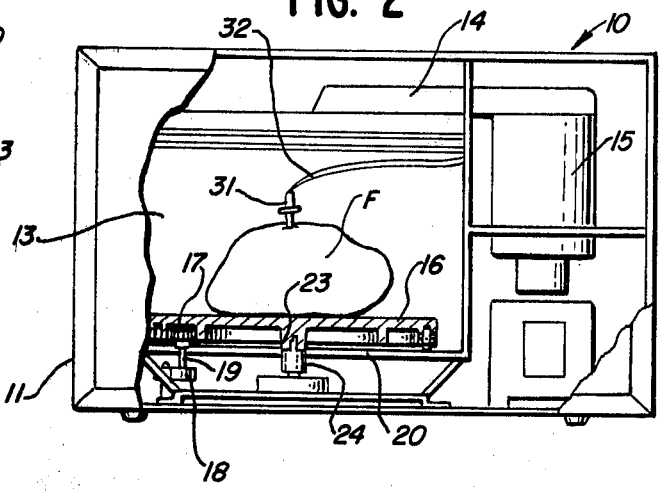
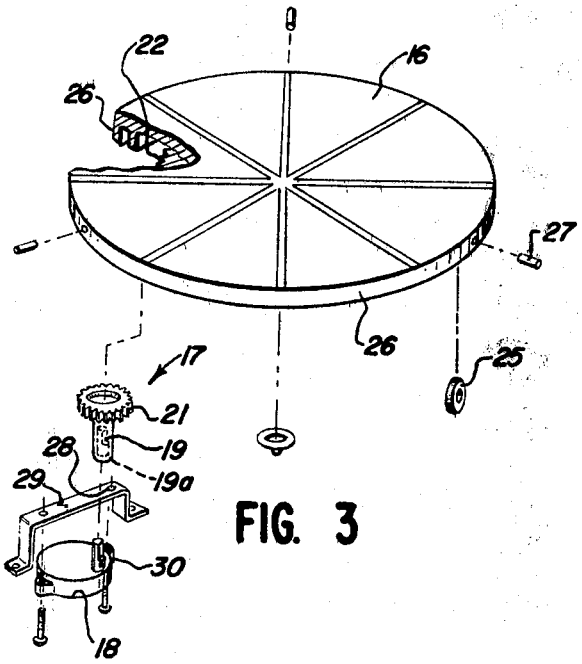
FIG. 3
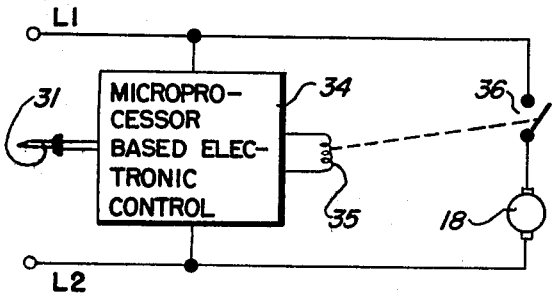
FIG. 4
FIG. 5
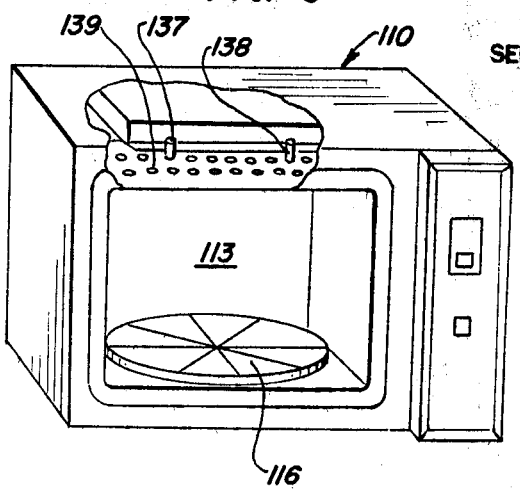
FIG. 6
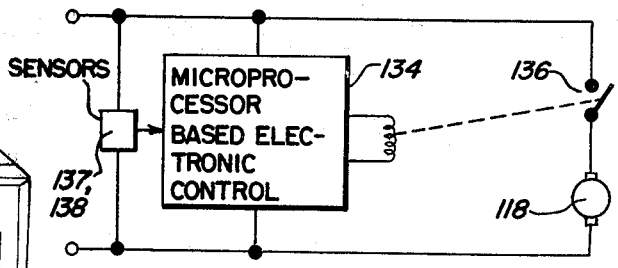

CONTROLLED MOVABLE SUPPORT FOR MICROWAVE OVEN

BACKGROUND OF THE INVENTION

1. Field of the Invention

This invention relates to microwave ovens and in particular to means for controlling the dispositon of the food being cooked within the oven cavity during the cooking cycle.

2. Description of the Prior Art

A number of devices have been developed for rotating supports. Illustratively, in U.S. Pat. No. 1,515,443 of Joseph M. Redinger, an intermittently revolving display stand is provided wherein a plurality of cams cooperate with a pawl for intermittently rotating the display.

Peter H. Smith, in U.S. Pat. No. 3,373,259, shows an electronic oven having a motor-driven rotatable platform.

James E. Staats, in U.S. Pat. No. 3,377,562, shows a platform in a microwave oven cavity driven by a motor.

In U.S. Pat. No. 4,036,151, Yasuo Shin shows a microwave cooking apparatus wherein a turntable is rotated by a drive motor.

Junzo Tanaka et al, in U.S. Pat. No. 4,131,778, show a microwave oven wherein a rotary table is rotated through magnetic coupling means.

SUMMARY OF THE INVENTION

The present invention comprehends an improved microwave oven structure wherein a movable support is controlled to reposition the food during the cooking cycle to effect a desired uniform cooking thereof.

The food support is arranged to be selectively positioned in a plurality of preselected different discrete positions during the cooking cycle. More specifically, the support is arranged to move the food from the original position to at least one additional position during the cooking cycle.

In the illustrated embodiment, the support comprises a rotatable table. The control is arranged to rotate the table, as through a motor drive thereof, to the different desired positions.

The control may be effected as a function of time. Alternatively, the control may be provided as a function of a sensed condition of the food, such as a temperature condition thereof.

In an illustrated embodiment, the control senses a temperature differential between different portions of the food, and effects the desired movement of the food so as to reduce the differential and, thus, provide a more uniform heating of the food in the cooking cycle.

The movement of the support may be limited so as to permit the use of a conventional temperature sensing probe inserted in the food being cooked without damage to the wires connecting the probe to the control. Where the support comprises a rotatable turntable, the movement of the turntable effected by the control is preferably no greater than approximately 360°, thereby effectively avoiding twisting of the probe wires.

The sensing means may comprise infrared sensors mounted in the wall of the oven cavity.

The movable support may be removably installed in the oven cavity. The control may be arranged to provide a continuous time-cooking cycle in the event the movable support is removed from the oven cavity and may be arranged to provide automatic sensed control upon installation of the movable support in the oven cavity.

If desired, the control may be arranged to provide a continuous movement of the movable support.

The microwave oven structure of the present invention is extremely simple and economical of construction while yet providing the highly desirable improved uniform cooking operation and the other features discussed above.

BRIEF DESCRIPTION OF THE DRAWING

Other features and advantages of the invention will be apparent from the following description taken in connection with the accompanying drawing wherein:

FIG. 1 is a perspective view of a microwave oven having an improved food supporting means embodying the invention;

FIG. 2 is a front elevation of the microwave oven with portions broken away and partially in section for facilitated illustration of the rotatable food support;

FIG. 3 is an exploded view of the rotatable food support;

FIG. 4 is a schematic wiring diagram of the control;

FIG. 5 is a perspective view with a portion broken away illustrating a modified form of control for use in the microwave oven;

FIG. 6 is a schematic wiring diagram of the modified control of FIG. 5;

DESCRIPTION OF THE PREFERRED EMBODIMENTS

Figure 7:
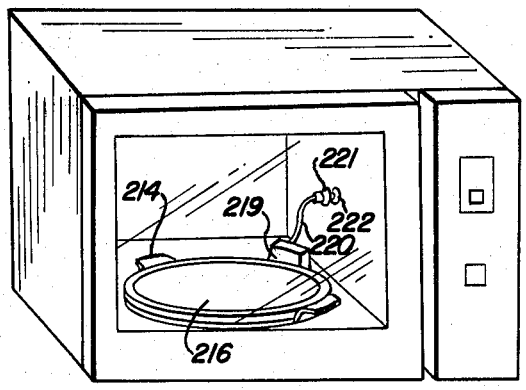
FIG. 7 is a perspective view illustrating a removable accessory rotatable food support embodying the invention.

In the exemplary embodiment of the invention as disclosed in the drawing, a microwave oven generally designated 10 is shown to comprise an outer cabinet 11 having a front access door 12 providing controlled access to an oven cavity 13 within the cabinet.

Microwave energy is delivered to the oven cavity 13 through a waveguide 14 from a magnetron 15 of conventional construction.

Microwave energy delivered to the oven cavity 13 effects a cooking of food F disposed within the oven cavity during the cooking cycle. It has been found, however, that uneven cooking of the food may occur at times and that repositioning of the food within the cavity is desirable to effect more uniform cooking of the food. Illustratively, it is conventional to effect any rotation of the food within the cavity approximately 90° one or more times during the cooking cycle. This is conventionally effected by the user stopping the cooking cycle, opening the access door, and manually rotating the food in the cavity.

A number of the prior art patents discussed above provide a rotation of the food within the oven cavity by supporting the food on a rotatable table. A problem, however, arises in such a continuously rotating support in that stratification of the ingredients within a receptacle on the support may occur so that such movement is not completely satisfactory in providing desirable uniform heating of the food.

The present invention comprehends providing means for movably supporting the food to be cooking in a plurality of preselected different discrete positions during the cooking cycle. In the illustrated embodiment shown in FIGS. 2 and 3, the movable support comprises a turntable 16 rotatably driven by a drive 17 from an electric motor 18. The drive includes a vertical shaft 19 extending upwardly through a bottom wall 20 of the oven cavity and integrally carrying a gear 21 engaging a gear 22 integrally formed on the turntable 16. The turntable includes a center hub portion 23 journaled on a support 24 for rotatably supporting the turntable in the oven cavity. The turntable may further be provided with a plurality of wheels 25 rotatably carried on the rim 26 thereof by pins 27.

Shaft 19 extends downwardly through a suitable opening 28 in a motor mounting bracket 29 so as to engage a flatted drive shaft 30 of the motor 18 in an internal D shaped bore 19*a*.

Turntable 16 may be removed from oven cavity 13 by raising the turntable upwardly from bottom wall 20 to disengage the hub 23 from support 24 and the turntable from gear 21 of drive 17. After removal of the turntable 16, gear 21 may be removed by raising the gear to disengage the shaft 19 from the motor shaft 30.

As indicated above, a temperature sensing probe 31 may be provided for sensing the temperature of the food F, the probe being provided with suitable electrical control wires 32, as indicated in FIG. 2. As shown in FIG. 1, suitable manually operable control means 33 may be provided on cabinet 11 for initiating the cooking cycle. Probe 31 may be associated therewith to discontinue the cooking cycle when the desired temperature condition of the food F is sensed by the probe.

As shown in FIG. 4, the invention comprehends the provision of a control 34 for controlling the energization of the turntable drive motor 18 so as to effect a controlled rotation of the turntable. More specifically, the invention comprehends the provision of the control 34 to cause the turntable to be moved to one or more preselected different discrete positions during the cooking cycle. The control 34 may comprise a conventional microprocessor having an output controlling a relay coil 35 which, in turn, controls a switch 36 in series with the drive motor 18 across the power supply leads L1 and L2. Control 34 may be arranged to close switch 36 and thereafter to open switch 36 automatically after a preselected time so as to energize motor 18 to rotate the turntable 16 a preselected amount, such as 90°. Control 34 may be further arranged to provide additional incremental movements if desired so as to support the food F in a desired plurality of preselected different discrete positions during a cooking cycle.

Where the probe 31 is utilized, it is desirable to limit the amount of rotation of turntable 16 so as to avoid damage to the probe wires 32 as by twisting thereof. Illustratively, the rotation of turntable 16 may be limited to approximately 360° or less.

Further, control 34 may be provided with suitable means for permitting the user of the microwave oven to program the desired controlled movement of the turntable at the same time the operation of the microwave generating means is programmed, as in the conventional microwave oven controls.

Control 34 further may be selectively operated to effect a continuous rotation of the turntable when desired. Where the probe 31 is utilized, the rotation may be limited to approximately 360° or less, as discussed above. Alternatively, where the probe 31 is not utilized, the rotation may be continued as desired during the cooking cycle, as in the conventional prior art turntable means. In the illustrated embodiment, the turntable is rotated at a rate of approximately ½ rpm by the motor 18.

Controls 33 and 34 may be arranged so as to discontinue the delivery of microwave energy to the oven cavity during the time the turntable is being rotated to a different discrete position.

Illustratively, the control 34 may be programmed to divide the cooking time set by control 33 into two equal periods, with the drive motor switch 36 being closed at the midpoint of the time period to rotate the turntable such as one-quarter or one-half turn, as desired, at that time.

The probe 31 may be connected to control 34, as shown in FIG. 4, so as to permit the control to effect the desired operation of motor 18 as a function of a temperature sensed by the probe. Illustratively, the control 34 may be actuated by probe 31 to effect a closed interval of switch 36 to energize motor 18 for a discrete respositioning of the turntable 16 when a first temperature is reached in the food F, and to terminate the cooking cycle when a second, higher temperature is sensed.

A modified form of microwave oven generally designated 110 embodying the invention is illustrated in FIG. 5. As shown therein, a pair of infrared sensors 137 and 138 may be mounted in the wall 139 of oven cavity 113 to sense temperature conditions at different portions of the food placed on the turntable 116. The control 134 is connected to the sensors 137 and 138 so as to effect a closing of switch 136 to energize motor 118 whenever the sensors detect a temperature difference therebetween exceeding a preselected amount. Thus, the food carried on turntable 116 is automatically turned whenever an uneven heating of the food is detected. Control 134 may effect the repositioning of the turntable by a continuous rotation thereof for a preselected period of time. Alternatively, control 134 may be programmed to rotate the turntable a preselected amount, such as one-quarter or one-half turn. Further alternatively, control 134 may be arranged to provide a continued rotation of the turntable until the temperature difference sensed by sensors 137 and 138 drops below a preselected value.

Thus, as discussed above, the present invention comprehends the provision of an improved control for controlling the positioning of a movable support for the food being cooked in a microwave oven. The control provides a uniform cooking operation without the need for the user of the microwave oven to effect a manual repositioning of the food within the cavity during the cooking cycle. By the provision of such improved control of the uniformity of the cooking operation, a reduction in the total amount of energy necessary to provide a proper cooking of the food is obtained.

The invention comprehends the alternative utilization of a programmed timer for effecting the desired repositioning of the food during the cooking operation, or sensing means for determining the existence of an uneven cooking condition of the food to effect the desired repositioning. The illustrated sensing devices are exemplary only, it being obvious to those skilled in the art that a wide range of suitable sensing detectors may be utilized for controlling the movement of the movable support 16 within the scope of the invention.

As the turntable 16 is removably installed in the oven cavity, the oven cavity may be utilized when desired without the movable support. As the gear 21 is removable together with the turntable 16, these elements may be readily cleaned when desired. It may be desirable to provide a switch means to prevent infrared sensed operation of the microwave oven whenever the turntable is removed.

The improved food support means avoids the stratification that may occur in the prior art rotational support devices while yet providing the highly desirable preselected repositioning of the food in the oven cavity from time to time as required by the cooking conditions of the food.

The turntable defines a relatively low profile so as to effectively maximize the cavity volume receiving the food F. As the turntable is rotated by the drive 17 at a low rate of rotation, such as ½ to ¾ rpm, the motor 18 may be a small permanent magnet motor while yet relatively heavy loads of 25 lbs or more may be effectively carried on the rotatable turntable.

While a pair of infrared sensors has been illustrated in the embodiment of FIGS. 5 and 6, as will be obvious to those skilled in the art, any suitable number of sensors may be employed and located as desired on different wall portions of the cavity within the scope of the invention.

The removal of the turntable and gear permits the microwave oven to be utilized in the normal manner for many foods as desired. The readily installed turntable and drive and operation thereof under the controls 34 and 134, as discussed above, provides a substantial further improvement in the efficient utilization of such microwave ovens, as discussed above.

Figure 8:
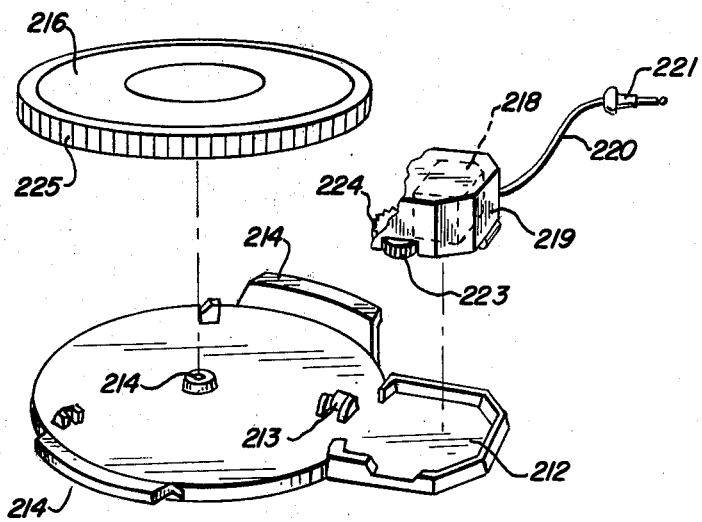
FIG. 8 is an exploded view of the removable accessory rotatable food support.
Figure 9:
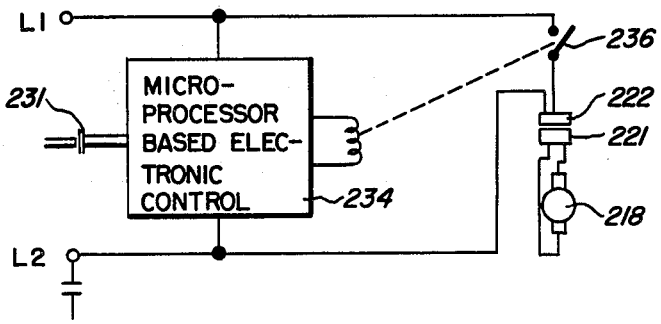
FIG. 9 is a schematic wiring diagram of the modified control of FIG. 7.

Another modified form of microwave oven generally designated 210 embodying the invention is illustrated in FIGS. 7, 8 and 9. In FIGS. 7 and 8, a microwave oven turntable accessory, generally designated 211, is illustrated within an oven cavity 213. The movable support comprises a turntable 216 rotatably driven through external gear teeth 225 by a drive pinion 224 driven by an electric motor 218. The turntable 216 is supported on a base 211 having a center alignment hub 214 and a plurality of support wheels 213. The base 211 also provides a portion 212 for supporting a motor housing 219 containing motor 218.

As shown in FIG. 7, the base 211 may be positioned within the oven cavity 213 to provide a movable support or may be removed as facilitated by handles 214 provided on base 211. When positioned within the oven cavity 213, an electrically connecting plug 221, having a line 220 electrically connected to motor 218, may be utilized to provide a source of energy to motor 218. A manually operable ON-OFF switch 223 may be provided. As shown in FIG. 9, the operation of the electrical circuit is the same as that described in FIG. 4, having a microprocessor based electronic control 234, a temperature probe 213, and a source of electrical power across leads L1, L2. The motor 218 is located within the oven cavity 213 and electrically connected to the circuit by line 220 and plug 221 into a mating female plug 222 mounted in cavity wall 213*a*. Thus, the turntable accessory may be utilized with any of the circuit operations previously described, including movement of the rotatable support to different discrete positions as a function of time, temperature as sensed by a temperature probe, or temperature differential as sensed by infrared sensors.

The removability of the turntable accessory allows the microwave oven to be utilized in a conventional manner, or by insertion in the cavity of the turntable accessory, to be utilized in accordance with the principles of the invention set forth herein.

The foregoing disclosure of specific embodiments is illustrative of the broad inventive concepts comprehended by the invention.

I claim:

1. In a microwave oven having wall means defining an oven cavity, means for providing microwave energy in said cavity during a cooking cycle, and movable means within said cavity for supporting material to be cooked in first and second different discrete positions during the cooking cycle, the improvement comprising control means responsive to a partially cooked condition of the material to be cooked for moving said movable means to move the partially cooked material from said first position to said second position, said control means being arranged to preclude further movement of the material during the cooking cycle whereby the material is disposed in no more than two different discrete positions during the entire cooking cycle.

2. The microwave oven structure of claim 1 wherein said means for supporting the material comprises a rotatable member and said discrete positions comprise discrete rotational positions of said member.

3. The microwave oven structure of claim 1 wherein said means for supporting the material comprises a rotatable member and said discrete positions comprise positions less than 360° apart.

4. In a microwave oven having wall means defining an oven cavity, means for providing microwave energy in said cavity during a cooking cycle, and rotatable means within said cavity for supporting material to be cooked, the improvement comprising means for effecting rotation of said rotatable means from a first position to a second position spaced from said first position no greater than approximately 360° at a preselected time after initiation of provision of microwave energy to said cavity, the total rotation of the rotatable means during the cooking cycle being no greater than approximately 360°.

5. The microwave oven structure of claim 4 wherein said positions comprise discrete rotational positions of said rotatable means approximately 90° apart.

6. The microwave oven structure of claim 4 wherein said positions comprise discrete rotational positions of said rotatable means approximately 180° apart.

7. The microwave oven structure of claim 4 further including an adjustable control for effecting movement of said rotatable means to said second position at any one of a plurality of different preselected times.

8. In a microwave oven having wall means defining an oven cavity and means for providing microwave energy in said cavity, the improvement comprising:

movable means for supporting material to be cooked in a plurality of preselected different discrete positions during the cooking cycle;

means for sensing the temperature of said material at two spaced positions; and means for moving said support means to a new discrete position when said sensing means senses a temperature difference exceeding a preselected amount.

9. The microwave oven structure of claim 8 wherein said sensing means comprises a radiation sensor responsive to radiation from said material.

10. The microwave oven structure of claim 8 wherein said sensing means comprises an infrared radiation sensor responsive to infrared radiation from said material.

11. The microwave oven structure of claim 8 wherein said sensing means comprises a plurality of radiation sensors responsive to radiation from different portions of said material.

12. The microwave oven structure of claim 8 wherein said sensing means comprises a plurality of infrared radiation sensors responsive to infrared radiation from different portions of said material.

13. The microwave oven structure of claim 1 wherein said movable means comprises a rotatable table removably disposed within said cavity for rotational movement of food placed on said table, and a motor drivingly connected to said table to cause rotation of the table when said motor is energized.

14. The microwave oven structure of claim 1 wherein said control means includes a temperature sensing probe insertable into the food being cooked for sensing said condition of the food, and said control is arranged to provide a total rotation of said table of no greater than approximately 360°.

15. The microwave oven structure of claim 1 wherein said control means comprises means for sensing a temperature differential in the food being cooked by said microwave energy and means for causing movement of the movable means upon a sensing of a preselected temperature differential in the food by said sensing means.

16. The microwave oven structure of claim 1 wherein said control comprises infrared sensing means for sensing a temperature condition of the food being cooked by said microwave energy, said movable means being removably installed in said cavity, and said infrared sensing means being operable only when said table is installed in said cavity.

17. The microwave oven structure of claim 1 including means for preventing provision of microwave energy to said cavity during movement of the movable means.

18. In a microwave oven having wall means defining an oven cavity and means for providing microwave energy in said cavity during a cooking cycle, the improvement comprising:

rotatable turntable means removably supported within said cavity for supporting material to be cooked in a plurality of preselected different discrete positions during the cooking cycle, the total rotation of the turntable means during the cooking cycle being no greater than approximately 360°, said turntable means having an electric drive means; and means for electrically connecting the drive means to a source of electrical potential outside said cavity with said turntable means disposed within the cavity for controlled discrete operation of the drive means.

19. The microwave oven structure of claim 18 wherein said turntable means includes an electrical plug for connection to a mating electrical plug in a side wall of said cavity for providing said electrical connection to said source of electrical potential.

* * * * *